US005240387A

United States Patent [19]

Nakajima et al.

[11] Patent Number: 5,240,387

[45] Date of Patent: Aug. 31, 1993

[54] VARIABLE CAPACITY VANE COMPRESSOR HAVING AN IMPROVED BEARING ARRANGEMENT FOR A DRIVE SHAFT AND A CAPACITY CONTROL ELEMENT

[75] Inventors: Nobuyuki Nakajima; Tatsuo Nakaya, both of Konan, Japan

[73] Assignee: Zexel Corporation, Tokyo, Japan

[21] Appl. No.: 880,137

[22] Filed: May 7, 1992

[30] Foreign Application Priority Data

May 10, 1991 [JP] Japan ..... 3-135815

[51] Int. Cl.[5] ..... F04B 49/00

[52] U.S. Cl. ..... 417/295; 417/DIG. 1

[58] Field of Search ..... 417/295, DIG. 1; 384/905, 557

[56] References Cited

U.S. PATENT DOCUMENTS

| | | | |
|---|---|---|---|
| 4,473,309 | 9/1984 | Box | 384/905 |
| 4,573,809 | 3/1986 | Jacob | 384/905 |
| 4,772,139 | 9/1988 | Betton | 384/905 |
| 4,809,833 | 3/1989 | Brunhen et al. | 384/905 |
| 5,028,152 | 7/1991 | Hill et al. | 384/557 |
| 5,044,908 | 9/1991 | Kawade | 384/557 |

FOREIGN PATENT DOCUMENTS 63-205493 8/1988 Japan .

*Primary Examiner*—Richard A. Bertsch
*Assistant Examiner*—Alfred Basichas
*Attorney, Agent, or Firm*—Frishauf, Holtz, Goodman & Woodward

[57] ABSTRACT

A variable capacity vane compressor includes a bearing arrangement having a radial bearing radially supporting a drive shaft of the compressor, and a thrust bearing rotatably supporting a capacity control element. The bearing arrangement comprises an annular member fixed in a through hole formed through a side block of the compressor, through which the drive shaft extends. The annular member has an inner peripheral surface in which the radial and thrust bearings are received. The annular member is formed of a material having a coefficient of thermal expansion substantially equal to that of a material forming the radial bearing. The thrust bearing has a first race disposed on a side thereof close to a rotor of the compressor, and a second race disposed on a side remote from the rotor. The first race is force-fitted in a through hole formed through the capacity control element and slidably fitted in the inner peripheral surface of the annular member. The first and second races have respective inner peripheral surfaces thereof spaced from an outer peripheral surface of the drive shaft.

12 Claims, 10 Drawing Sheets

VARIABLE CAPACITY VANE COMPRESSOR HAVING AN IMPROVED BEARING ARRANGEMENT FOR A DRIVE SHAFT AND A CAPACITY CONTROL ELEMENT

BACKGROUND OF THE INVENTION

This invention relates to a variable capacity vane compressor, and more particularly to improvements in a bearing arrangement for a drive shaft and a capacity control element used in a variable capacity vane compressor.

A variable capacity vane compressor for use in automotive air conditioners has been proposed by Japanese Provisional Patent Publication (Kokai) No. 63-205493, which comprises, as shown in FIG. 1, a cylinder formed by a pair of side blocks 3, 4, and a cam ring 1 having opposite ends closed by the associated side blocks 3, 4, a rotor 2 rotatably received within the cylinder, and a drive shaft 7 on which the rotor 2 is rigidly fitted. The side blocks 3, 4 have respective through holes 40, 141 through which the drive shaft 7 extends. Radial bearings 8, 9 are force-fitted in the respective through holes 40, 141 for supporting the drive shaft 7. The rear side block 4 has an annular recess 23 formed in a rotor side end face 4*a* thereof. A capacity control element 124 in the form of an annulus is rotatably fitted in the annular recess 23 for controlling timing of start of compression of a refrigerant gas. The control element 124 is supported by a thrust bearing 143 fitted in an annular recess 142 formed in an inner peripheral surface of the through hole 141 of the rear side block 4. The thrust bearing 143, which is sandwiched between and end wall 142*a* of the annular recess 142 facing toward the rotor 2 and an opposed side face 124*a* of the control element 124, supports the control element 124 only in the axial direction.

The control element 124 is directly fitted on the drive shaft 7, with its central through hole 124*b* penetrated by the shaft 7.

As shown in FIG. 2, the opposed side face 124*a* of the control element 124 has a pair of pressure-receiving protuberances 26, 26 formed thereon. One side face of each pressure-receiving protuberance receives suction pressure Ps and an urging force exerted by a torsion coiled spring 38 having one end thereof engaged in a rear head 6, whereas the other side face of same receives control pressure Pc, whereby, responsive to a difference between the sum of the suction pressure Ps and the urging force of the torsion coiled spring 38 and the control pressure Pc, the control element 124 rotates between the maximum capacity position and the minimum capacity position to vary the capacity or delivery quantity of the compressor between the maximum value and the minimum value.

However, the control element 124 is also biased in the radial direction so that, as shown in FIG. 3, the central through hole 124*b* of the control element 124 is disposed excentrically to the drive shaft 7. That is, the inner peripheral surface of the central through hole 124*b* is constantly in line contact with the outer peripheral surface of the drive shaft 7 as shown in FIG. 3 such that the control element 24 is guided by the drive shaft 7 during rotation. Consequently, when the compressor 7 rotates at a high speed or the compressor is in a high load condition, there can occur galling between the control element 124 and the drive shaft 7, which prevents smooth rotation of the control element, resulting in degraded controllability of the compressor, and causes the drive shaft 7 and the control element 124 to be rapidly worn, resulting in degraded reliability.

In order to eliminate these inconveniences, a variable capacity vane compressor having an improved bearing for the capacity control element has been proposed by U.S. Ser. No. 07/680,414 assigned to the present assignee, which has already been allowed.

According to this proposed compressor, as shown in FIG. 4, the control element 123 is fitted on a central annular projection 146*a* of a rotor side race 146 of a thrust bearing 143. The other race 144 of the thrust bearing 143 is received in an annular recess 142 formed in the inner peripheral surface of the through hole 141, and an annular member 145 force-fitted in the annular recess 142 and urging the race 144 against an end wall 142*a* thereof facing toward the rotor 2. The rotor side race 146 with the control element 124 fitted thereon is fitted in the annular member 145. Part of the circumference of the rotor side race 146 is in slidable contact with an inner peripheral surface 145*a* of the annular member 145, while the rest of the circumference is spaced from the inner peripheral surface 145*a* by the maximum distance $\delta$ (e.g. 30 to 50 $\mu$) as shown in FIG. 4. On the other hand, inner peripheral surfaces 146*c*, 146*d* of the respective central annular projection 146*a* and race 146 are spaced from the outer peripheral surface of the drive shaft 7 by a distance range S of e.g. $80\mu \pm 20\mu$ along the whole circumference thereof.

Thus, according to this bearing arrangement, the control element 124 is guided during rotation thereof by the inner peripheral surface 145*a* of the annular member 145, so that the inner peripheral surface 146*c* of the annular projection 146*a* which is force-fitted in the hole 124*b* of the control element and the inner peripheral surface 146*d* of the race 146 are always kept out of contact with the outer peripheral surface of the drive shaft 7. This makes it possible to prevent occurrence of galling between the control element 124 and the drive shaft 7 even when the drive shaft 7 rotates at a high speed or when the compressor is in a high load condition, and also reduce wear of the component members.

However, the side blocks 3, 4 are formed of aluminum or an aluminum alloy, while the radial bearings 8, 9 are formed of a ferrous material. Therefore, the bearing arrangement of this compressor including the thrust bearing 143 and the radial bearing 9 has the following disadvantage: Since the aluminum alloy has a coefficient of thermal expansion larger than the ferrous material, a gap between the radial bearing 9 and the inner peripheral surface of the through hole 141 of the rear side block 4 increases when the rear side block 4 and the radial bearing 9 undergo expansion due to an increase in the temperature during operation of the compressor, which causes noise due to chattering between the radial bearing 9 and the rear side block 9.

SUMMARY OF THE INVENTION

It is the object of the invention to provide a variable capacity vane compressor having an improved bearing arrangement for a drive shaft and a capacity control element thereof, which enables to prevent occurrence of galling and seizure between the control element and the drive shaft, as well as occurrence of noise, and reduce the amount of wear of the control element and the drive shaft.

To attain the above object, the invention provides a variable capacity vane compressor including a drive shaft, a rotor rigidly mounted on the drive shaft, a cylinder in which the rotor is rotatably received, the cylinder having a pair of side blocks, the side blocks each having formed therein a first hole through which the drive shaft extends, one of the side blocks having an end face facing the rotor and having a first annular recess formed therein, a capacity control element rotatably fitted in the first annular recess for controlling timing of start of compression of a refrigerant gas in the compressor, the capacity control element having an end face remote from the rotor, and a second hole through which the drive shaft extends, and a bearing arrangement arranged in the first hole of the one side block, the bearing arrangement having a radial bearing radially supporting the drive shaft, and a thrust bearing rotatably supporting the capacity control element, the thrust bearing having a first race disposed on a side thereof close to the rotor, and a second race disposed on a side remote from the rotor.

The variable capacity vane compressor according to the invention is characterized in that:

the bearing arrangement comprises an annular member fixed in the first hole of the one side block, the annular member having an inner peripheral surface in which the radial bearing and the thrust bearing are received, the annular member being formed of a material having a coefficient of thermal expansion substantially equal to that of a material forming the radial bearing, the first race of the thrust bearing being force-fitted in the second hole of the capacity control element and slidably fitted in the inner peripheral surface of the annular member, the first and second races having respective inner peripheral surfaces thereof spaced from an outer peripheral surface of the drive shaft.

Preferably, the annular member has a reduced-diameter hole receiving the radial bearing therein, and an increased-diameter hole receiving the thrust bearing therein, the first race of the thrust bearing on the rotor side being disposed in slidable contact with an inner peripheral surface of the increased-diameter hole of the annular member.

More preferably, the first race of the thrust bearing has an end face facing toward the rotor, and an annular projection formed integrally on the end face, the annular projection being force-fitted in the second hole of the capacity control element.

Preferably, the one side block is formed of aluminum or an alloy thereof, the annular member being formed of a material having a coefficient of thermal expansion smaller than that of aluminum.

More preferably, the annular member is formed of a ferrous metal.

Further preferably, the annular member is formed of hardened steel.

Preferably, the annular member is formed by casting in the first hole of the one side block.

The above and other objects, features, and advantages of the invention will become more apparent from the ensuing detailed description taken in conjunction with the accompanying drawings.

DETAILED DESCRIPTION

The invention will now be described in detail with reference to drawings showing an embodiment thereof.

Figure 5:
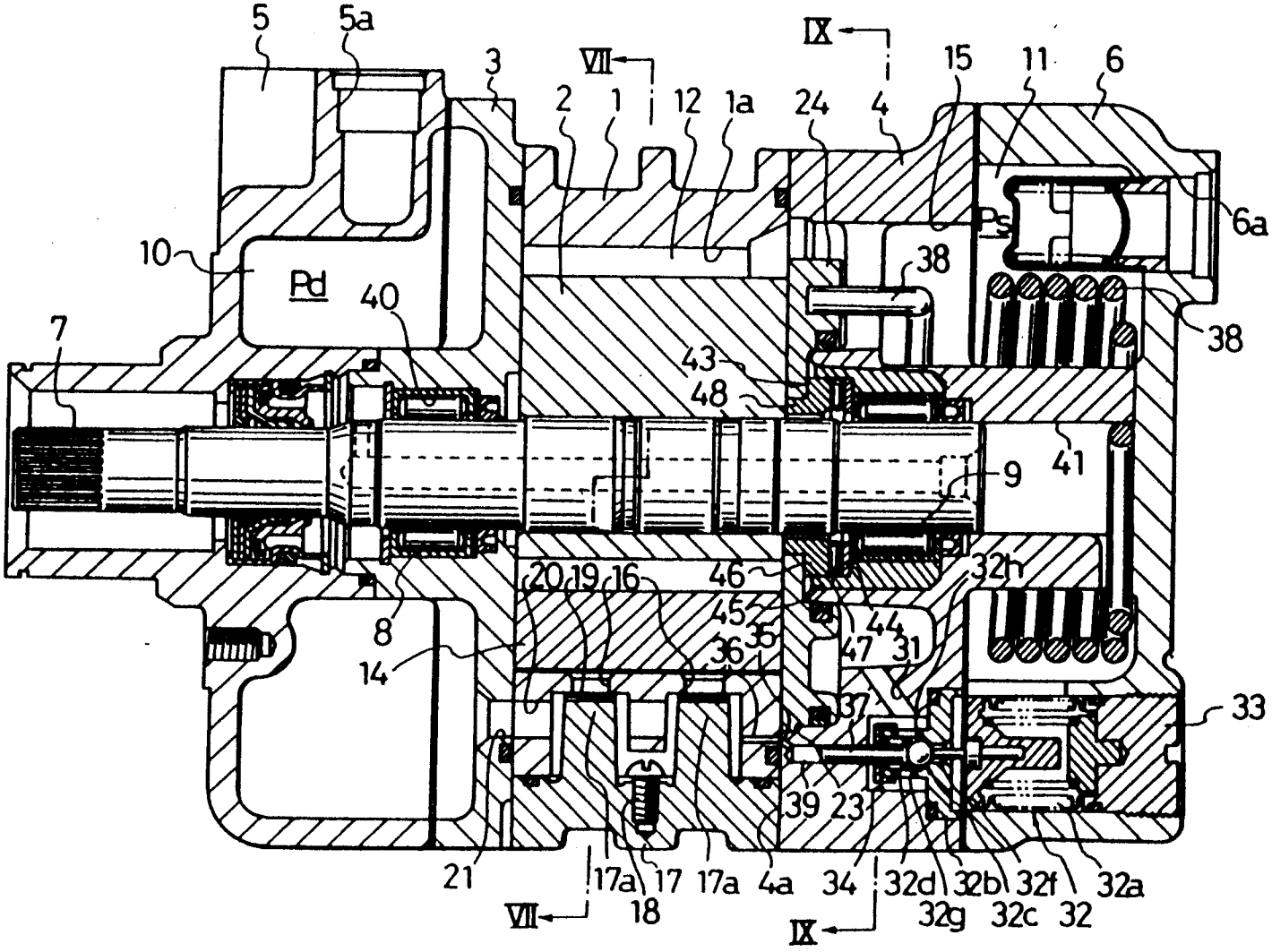
FIG. 5 is a longitudinal cross-sectional view of a variable capacity vane compressor including a bearing arrangement for a drive shaft and a capacity control element according to an embodiment of the invention.

FIG. 5 shows a variable capacity vane compressor having a bearing arrangement for a drive shaft and a capacity control element according to an embodiment of the invention.

Figure 6:
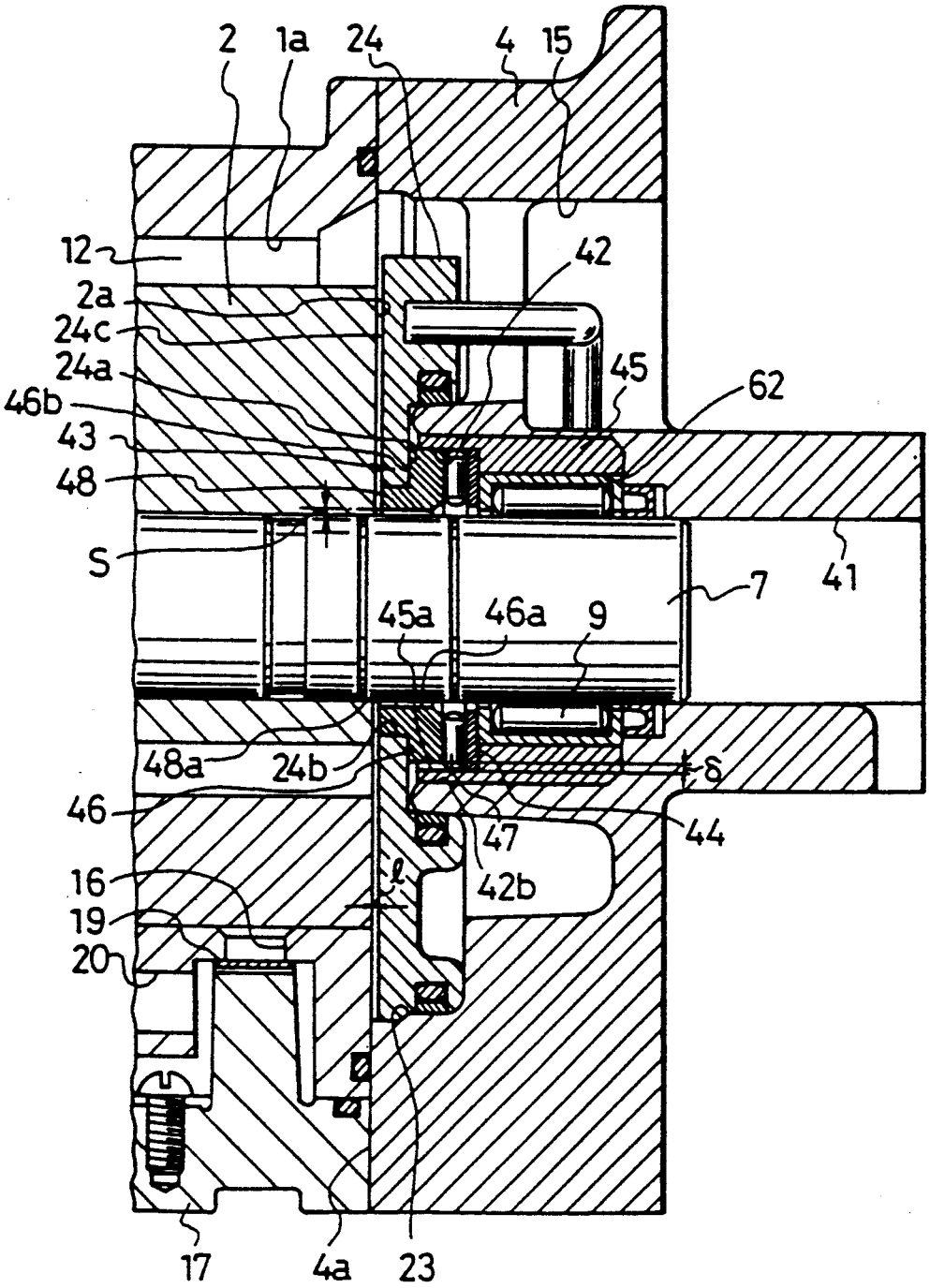
FIG. 6 is an enlarged fragmentary view showing a cross-section of the bearing arrangement appearing in FIG. 5.

As shown in FIGS. 5 and 6, the variable capacity vane compressor is composed mainly of a cylinder formed by a cam ring 1 having an inner peripheral surface 1*a* with a generally elliptical cross section, and a front side block 3 and a rear side block 4, formed of aluminum, preferably an aluminum alloy by die casting, closing open opposite ends of the cam ring 1, a cylindrical rotor 2 rotatably received within the cylinder, a front head 5 and a rear head 6 secured to outer ends of the respective front and rear side blocks 3 and 4, and a drive shaft 7 on which is rigidly fitted on the rotor 2.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

Figure 7:
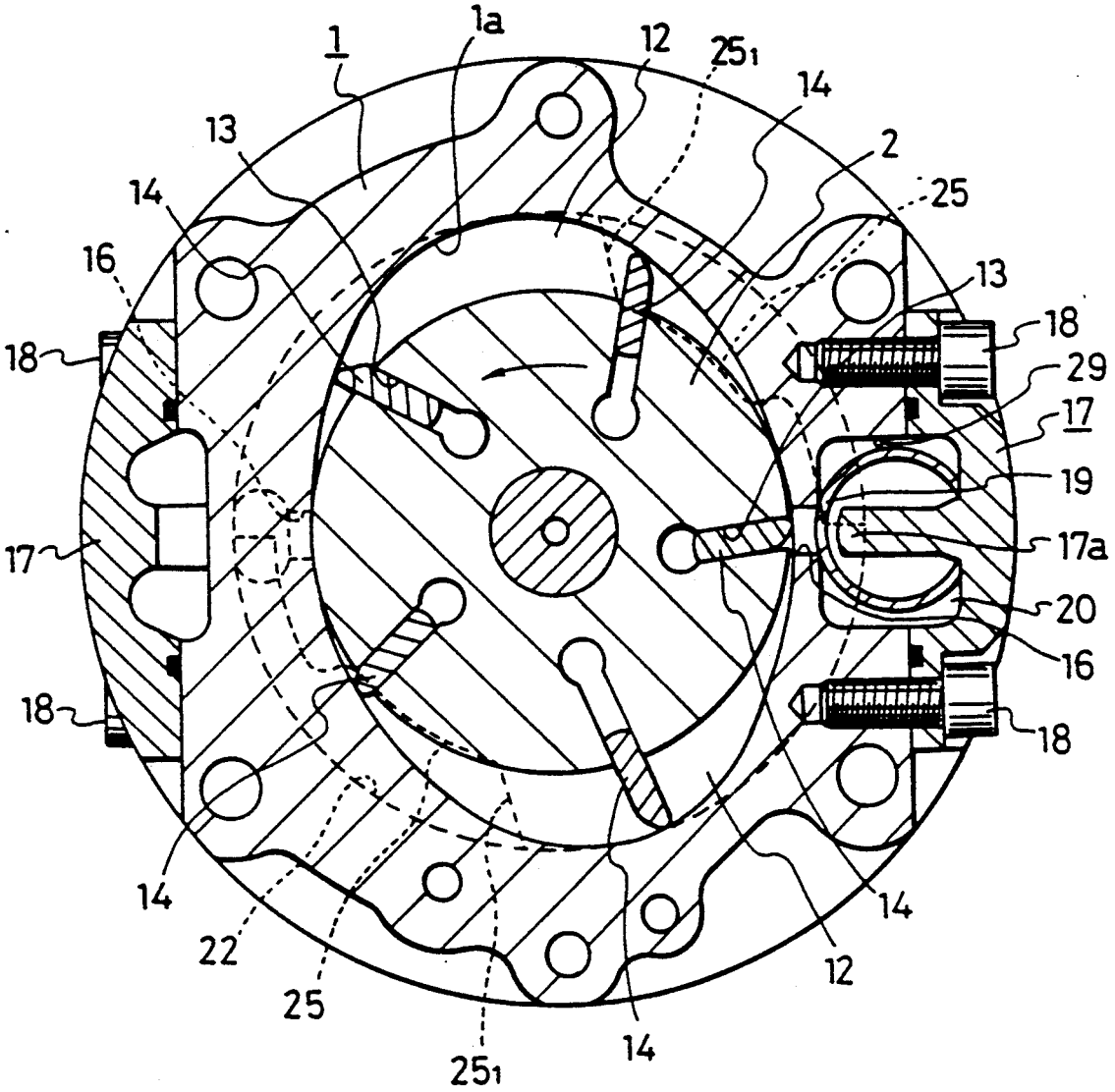
FIG. 7 is a transverse cross-sectional view taken along line VII—VII in FIG. 5, showing the control element in its maximum capacity position.

As shown in FIG. 7, a pair of compression spaces 12, 12 are defined at diametrically opposite locations between the inner peripheral surface 1*a* of the cam ring 1, the outer peripheral surface of the rotor 2, an end face of the front side block 3 on the cam ring 1 side, and an end face of a capacity control element 24 on the cam ring 1 side. The rotor 2 has its outer peripheral surface formed therein with a plurality of axial vane slits 13 at circumferentially equal intervals, in each of which a vane 14 is radially slidably fitted. As the rotor 2 rotates, each vane 14 slides at its front end along the inner peripheral surface 1*a* of the cam ring 1.

Figure 10:
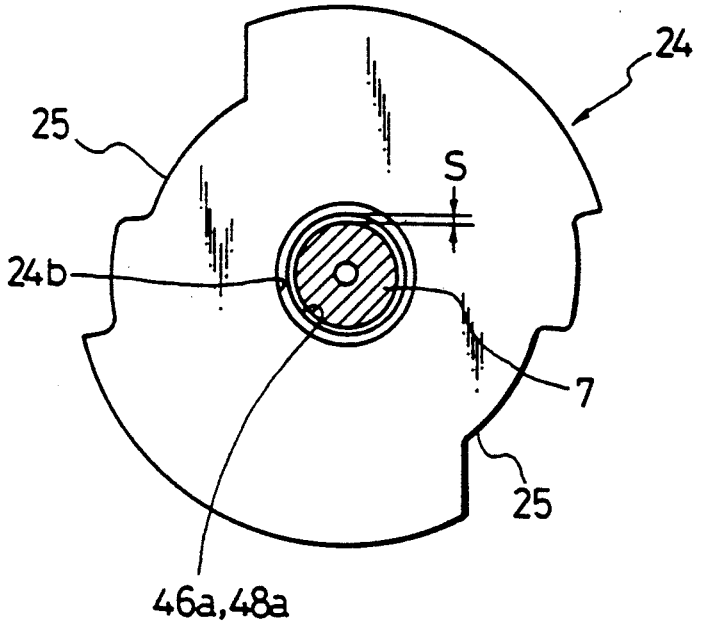
FIG. 10 is a view showing the positional relationship between the control element and the drive shaft, of the compressor according to the embodiment of the invention.

The side blocks 3, 4 are formed therein with respective through holes 40, 41, in which needle roller bearings as radial bearings 8, 9 are force-fitted, respectively, and rotatably support the drive shaft 7. The bearings 8, 9 are formed of a ferrous material such as iron. As shown in FIG. 6, an annular member 45 is cast in the through hole 41 formed through the rear side block 4. The annular member 45 is formed of a ferrous material, preferably hardened steel, which is hard and has high wear resistance and a smaller coefficient of thermal expansion than that of the aluminum alloy. The annular member has a through hole formed therethrough which comprises an increased-diameter portion 42 on the rotor side and a reduced-diameter portion 62 on the rear head side. The radial bearing 9 is force-fitted in the reduced-diameter portion 62 on the rear head side, while the increased-diameter portion 42 on the rotor side receives a thrust bearing 43 therein. Part of the circumference of a race 46 on the rotor side of the thrust bearing 43 is in slidable contact with an inner peripheral surface 45*a* of the annular member 45, and the rest of the circumference is spaced from the inner peripheral surface 45*a* by the maximum distance $\delta$ (e.g. 30–50$\mu$) as shown in FIG. 6. Further, the race 46 has an annular central projection 48 formed integrally on a side face 46*b* thereof facing the rotor 2, which is force-fitted in a central through hole 24*b* of the control element 24. Respective inner peripheral surfaces 48*a*, 46*a* of the annular projection 48 and race 46 are spaced from the outer peripheral surface of the drive shaft 7 by a distance range S of e.g. 80$\mu\pm$20$\mu$ along the whole circumference thereof, as shown in FIG. 10.

The bearing arrangement including the radial bearing 9 and the thrust bearing 43, constructed as above, is mounted into the compressor in the following manner: The radial bearing 9 is force-fitted into the reduced-diameter portion 62 of the through hole of the annular member 45 cast in the through hole 41 of the rear side block 41. Then, a race 44 on the rear head side is inserted into the increased-diameter portion 42, and then a needle roller assembly 47 is inserted into the increased-diameter portion 42 until it contacts the race 44. Then, the race 46 with the control element 24 previously rigidly fitted on its annular projection 48 is placed into the increased-diameter portion 42 until the race 46 contacts the needle roller assembly 47. Then, a clearance l between the control element 24 and the rotor 2, which clearance is shown in FIG. 6 and will be referred to again hereinafter, is measured to confirm whether the clearance l has a predetermined value. If it does not have the predetermined value, the race 44 is replaced by another one until the the measured clearance shows the predetermined value. When the adjustment of the clearance l is finished, this assembly process is completed.

Refrigerant inlet ports 15, 15 are formed in the rear side block 4 at diametrically opposite locations, as shown in FIG. 5 (since FIG. 5 shows a cross-section taken at an angle of 90° formed about the longitudinal axis of the compressor, only one refrigerant inlet port 15 is shown in the figure). These refrigerant inlet ports 15 axially extend through the rear side block 4, and through which the suction chamber 11 and the compression spaces 12 are communicated with each other.

Two pairs of refrigerant outlet ports 16, 16 are formed through opposite lateral side walls of the cam ring 1 at diametrically opposite locations as shown in FIGS. 5 and 7 (in FIG. 5, for the same reason as in the case of the refrigerant inlet ports, only one pair of the refrigerant outlet ports is shown). A discharge valve cover 17 having valve stoppers 17*a* is secured by bolts 18 to each of the opposite lateral side walls of the cam ring having the refrigerant outlet ports 16, 16 formed therein. Disposed between the lateral side wall and each of the valve stopper 17*a* is a discharge valve 19 which is retained on the discharge valve cover 17. The discharge valve 19 opens the associated refrigerant outlet port 16 in response to discharge pressure. Discharging spaces 20 which communicate with the respective pairs of refrigerant outlet ports 16 when the discharge valves 19 open are defined between the cam ring 1 and the respective discharge valve covers 17 at diametrically opposite locations. A pair of passages 21 are formed in the front side block 3 at diametrically opposite locations thereof, which each communicate with a corresponding one of the discharging spaces 20, whereby when each discharge valve 19 opens to thereby open the corresponding refrigerant outlet port 16, a compressed refrigerant gas in the compression space 12 is discharged from the discharge port 5*a* via the refrigerant outlet port 16, the discharging space 20, the passage 21, and the discharge pressure chamber 10, in the mentioned order.

Figure 8:
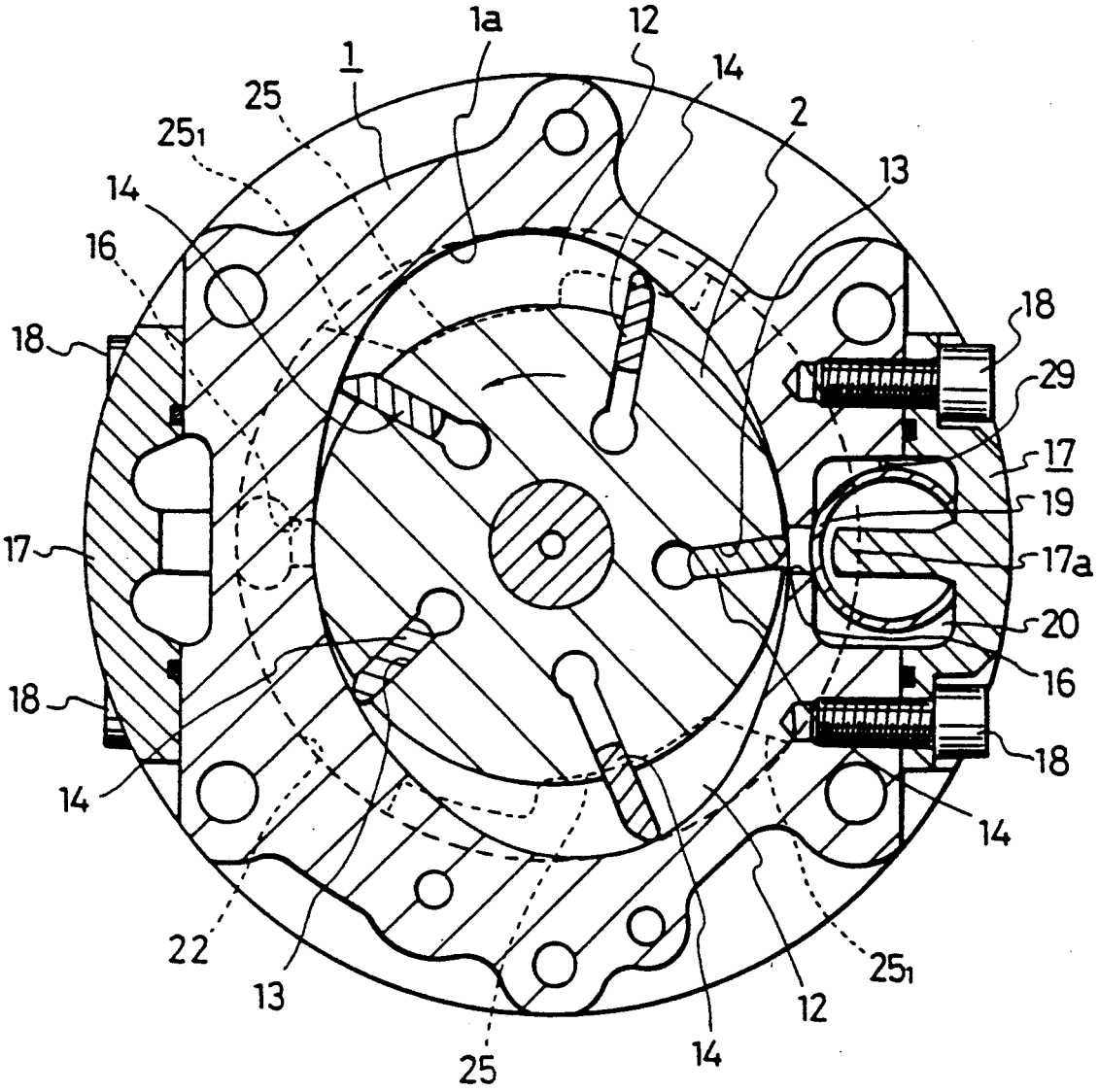
FIG. 8 is a view, similar to that of FIG. 7, showing the control element in its minimum capacity position.
Figure 9:
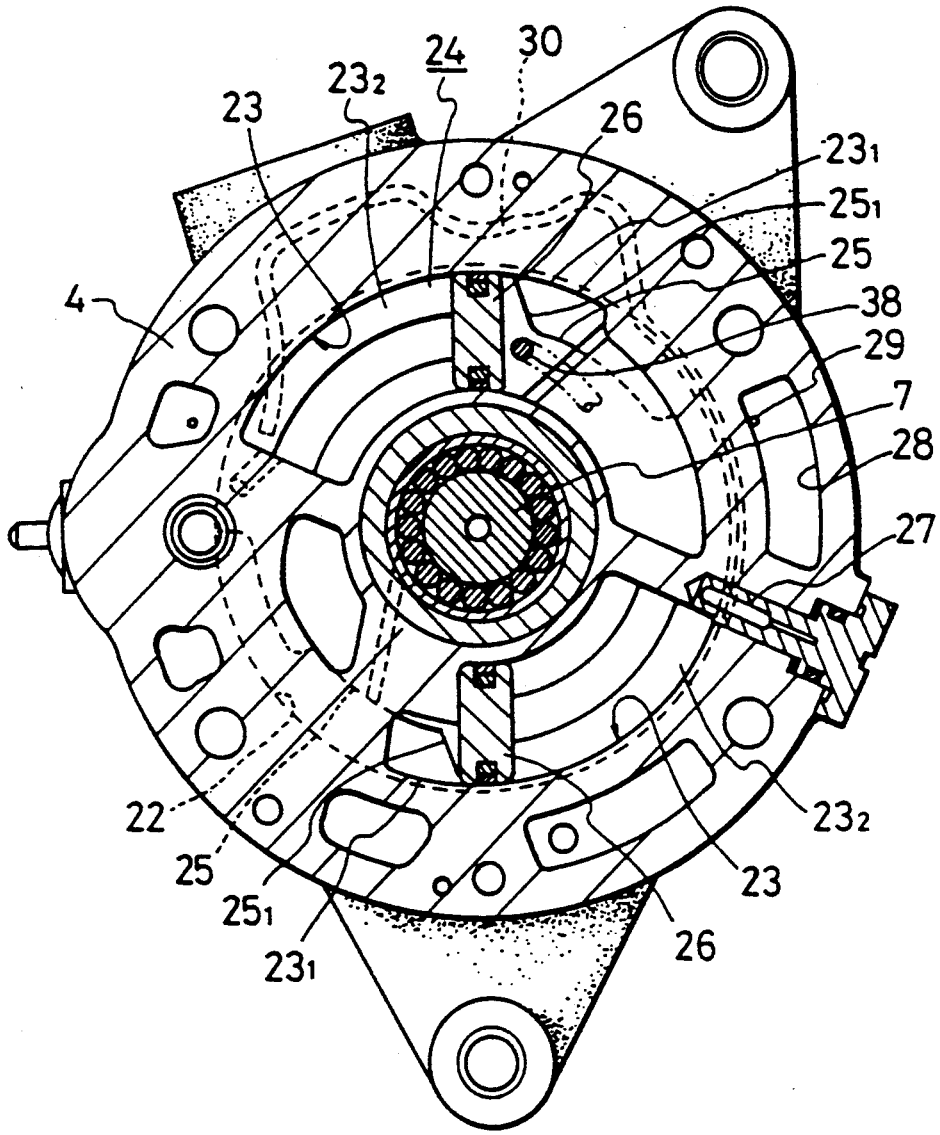
FIG. 9 is a transverse cross-sectional view taken along line IX—IX in FIG. 5.

As shown in FIGS. 5 to 9, the rear side block 4 has an end face facing the rotor 2, in which is formed an annular recess 23. A pair of pressure working chambers $23_1$, $23_2$ are defined in a bottom of the annular recess 23 at diametrically opposite locations. The capacity control element 24, which is in the form of an annulus, is received in the annular recess 23 for rotation about its own axis in opposite circumferential directions. The clearance l is provided between a side face 24*c* of the control element 24 facing the rotor 2 and an opposed end face 2*a* of the rotor 2, as shown in FIG. 6, to reduce the frictional resistance between the rotor 2 and the control element 24. The control element 24 controls the timing of start of compression of the compressor, and as shown in FIGS. 9 and 10, has its outer peripheral edge formed with a pair of diametrically opposite arcuate cut-out portions 25, 25, and its one side surface formed integrally with a pair of diametrically opposite pressure-receiving protuberances 26, 26 axially projected therefrom and acting as pressure-receiving elements. The pressure-receiving protuberances 26, 26 are slidably received in respective pressure working chamber 23, 23. The interior of each pressure working chamber 23 is divided into a low-pressure chamber $23_1$ and a high-pressure chamber $23_2$ by the associated pressure-receiving protuberance 26. Each low-pressure chamber $23_1$ communicates with the suction chamber 11 through the corresponding refrigerant inlet port 15 to be supplied with refrigerant gas under suction pressure Ps or low pressure. On the other hand, one of the high-pressure chambers $23_2$, $23_2$ is connected to one of the discharging spaces 20 through a restriction hole 27, a communicating groove, not shown, which is formed in the rear head 6 and communicates with the restriction hole 27, a passage 28 formed in the rear side block 4 and communicating with the communicating groove, and a control pressure-supply port 29 formed in the cam ring 1. The high-pressure chambers $23_2$, $23_2$ are connected to each other through a passage 30 formed in the rear head 6. In each of the high-pressure chambers $23_2$, control pressure Pc prevails, which is created by introducing into the chamber $23_2$ refrigerant gas under discharge pressure Pd or high pressure from the discharging space 20 by way of the restriction hole 27.

Figure 1:
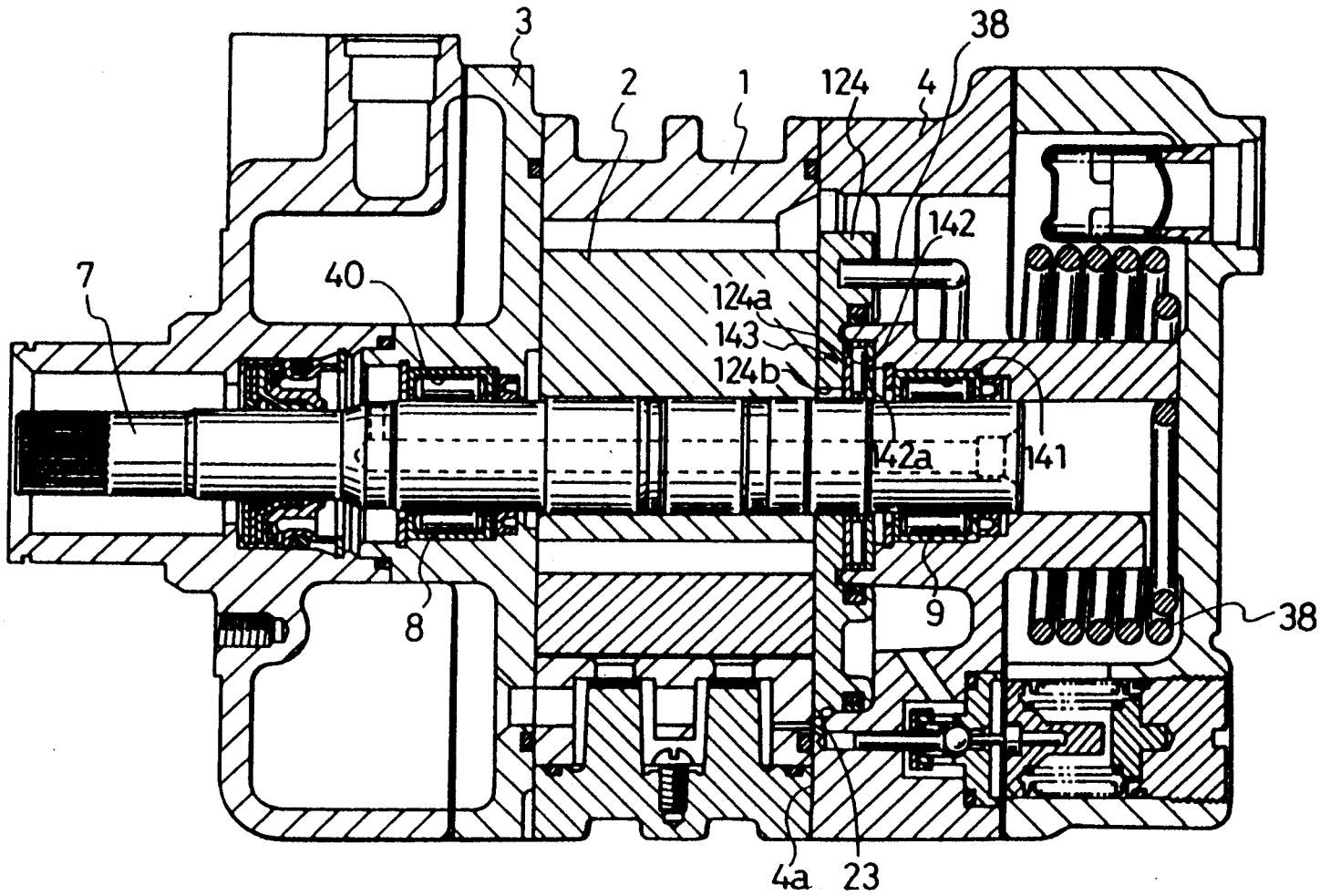
FIG.1 PRIOR ART
FIG. 1 is a longitudinal cross-sectional view of a conventional variable capacity vane compressor including a bearing arrangement for a drive shaft and a capacity control element thereof.
Figure 2:
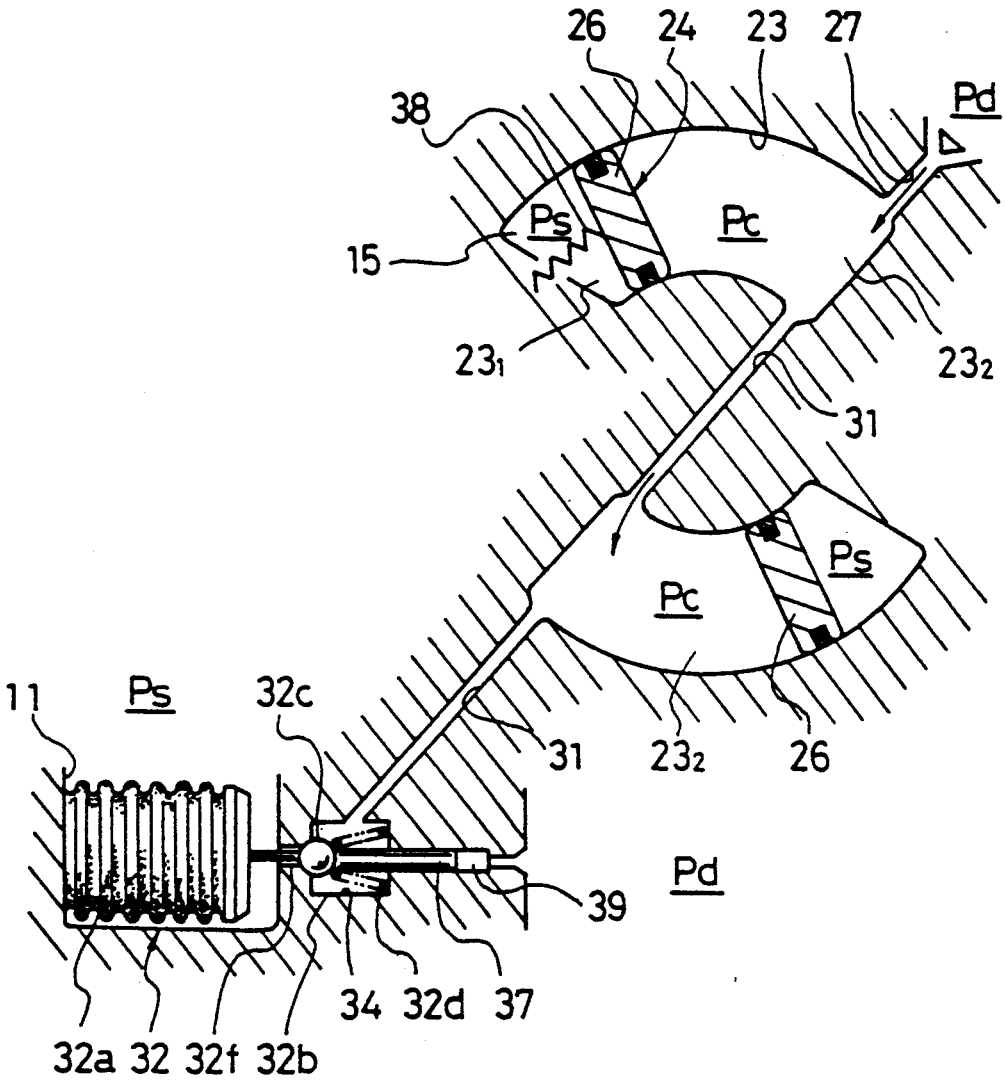
FIG.2 PRIOR ART
FIG. 2 is a view which is useful in explaining a mechanism for controlling the capacity of the compressor.
Figure 3:
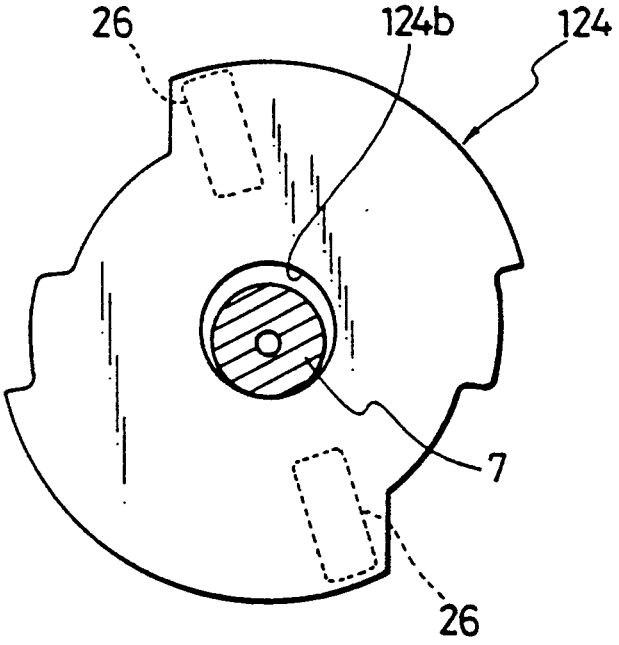
FIG.3 PRIOR ART
FIG. 3 is a view showing the positional relationship between the control element and the drive shaft, of the conventional compressor of FIG. 1.
Figure 4:
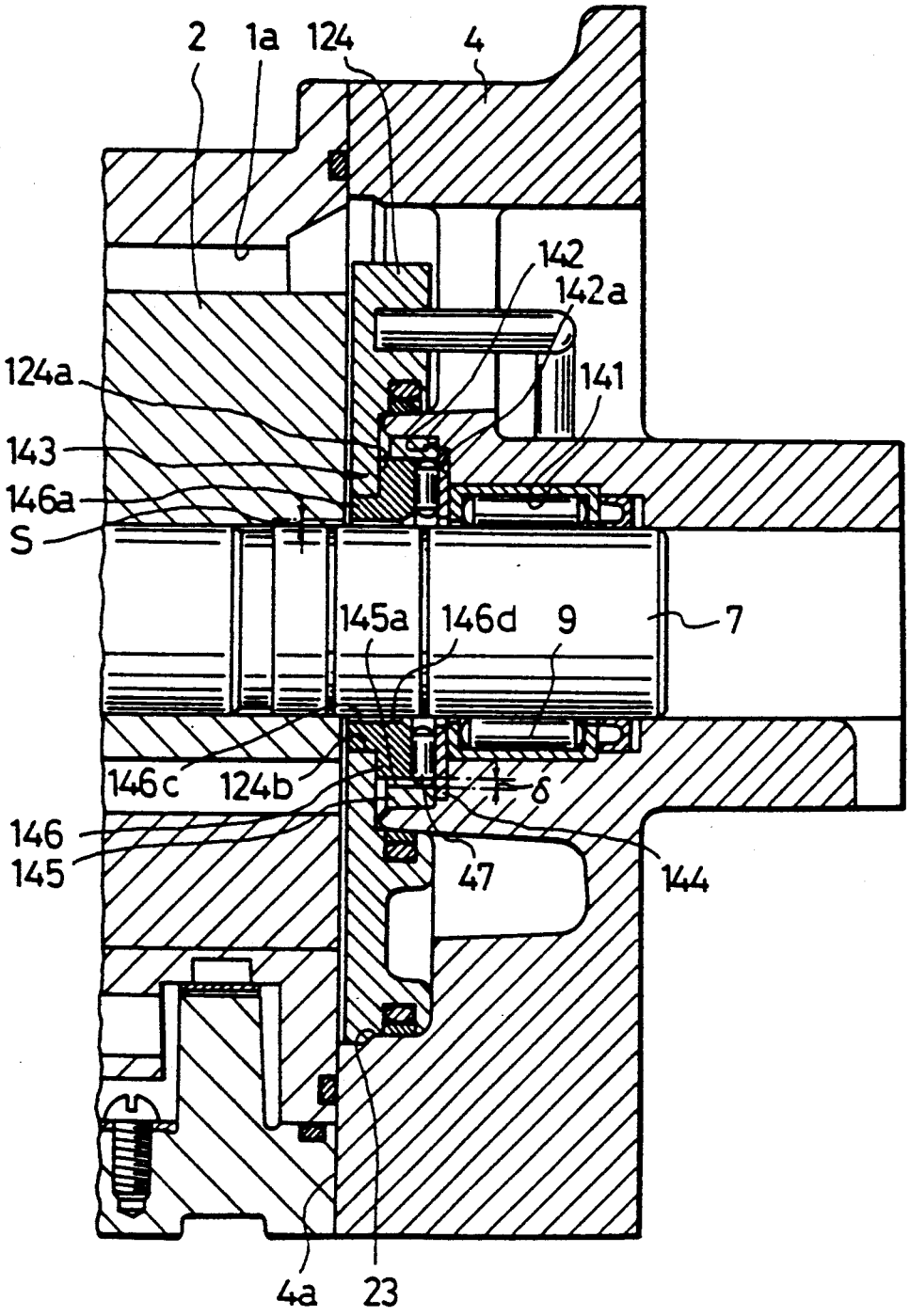
FIG.4 PRIOR ART
FIG. 4 is a fragmentary longitudinal cross-sectional view showing part of another conventional variable capacity vane compressor, which part includes a bearing arrangement including a bearing for a capacity control element.

As shown in FIGS. 5 and 2, one of the high-pressure chambers $23_2$, $23_2$ can be connected to the suction chamber 11 via a passage 31 formed in the rear side block 4 and a control valve device 32.

The control valve device 32 is operable in response to the suction pressure Ps prevailing within the suction chamber 11, whereby the control pressure Pc in the high-pressure chamber $23_2$ is allowed to leak into the suction chamber 11 when the control valve device 32 opens. The control valve device 32 comprises bellows 32*a* as a pressure-responsive member, a casing 32*b*, a ball valve element 32*c*, and a coiled spring 32*d* urging the ball valve element 32*c* in its closing direction. The bellows 32*a* is arranged in the suction chamber 11 for expansion and contraction. The casing 32*b* is mounted in a mounting hole 34 formed in the rear side block 4 and communicating with the passage 31. When the suction pressure Ps is above a predetermined level which is set by an adjusting member 33, the bellows 32*a* is in its contracted state, so that the ball valve element 32*c* closes a central hole 32*f* formed in the casing 32*b*. On the other hand, when the suction pressure Ps is not above the predetermined level, the bellows 32*a* is in its expanded state, so that the ball valve element 32*c* opens the central hole 32*f*. On this occasion, one of the high-pressure chambers $23_2$ is communicated with the suction chamber 11 via the passage 31, the mounting hole 34, a hole 32*g* formed in the casing 32*b*, a chamber 32*h* formed in the casing 32*b* and the central hole 32*f* in the casing 32*b*. A plunger 37 is slidably inserted into a through hole 39 formed in the rear side block 4. Discharge pressure Pd introduced from the discharging space 20 via a high pressure-introducing hole 35 acts on the plunger 37, to keep same in contact with the ball valve element 32*c*, to urge the latter in its closing direction.

Further, as shown in FIGS. 5 to 7, a torsion coiled spring 38 is arranged in the rear side block 4 and rear head 6 with one end thereof retained by the rear head 6 and the other end engaged with the control element 24 to urge the control element 24 toward its minimum capacity position as shown in FIG. 8.

The operation of the variable capacity vane compressor constructed as above will now be described.

In each compression space 12, the compression chamber on the suction stroke, which is defined between adjacent vanes, is supplied with refrigerant gas from the suction chamber 11 through the inlet port 15 and the associated cut-out portion 25 of the control element 24. Then, when the upstream one of the two adjacent vanes in the direction of rotation of the rotor 2 passes the downstream end $25_1$ of the cut-out portion 25 so that the compression chamber defined by the vanes becomes disconnected from the inlet port 15, compression is started. The compression starting timing becomes retarded as the control element 24 is circumferentially displaced away from the maximum capacity position as shown in FIG. 7 and toward the minimum capacity position shown in FIG. 8, whereby the delivery quantity or capacity is continuously decreased. In other words, when the control element is in the minimum capacity position, the downstream end $25_1$ of the cut-out portion 25 is positioned in the downstream extreme position in the direction of rotation of the rotor 2 and accordingly the compression is started at the latest timing. Consequently, the volume of refrigerant gas trapped between the two adjacent vanes is the minimum and hence the delivery quantity is the minimum. On the other hand, when the control element is in the maximum capacity position, the downstream end $25_1$ of the cut-out portion 25 is positioned in the upstream extreme position in the direction of rotation of the rotor to obtain the earliest compression starting timing so that the volume of refrigerant gas trapped between the two adjacent vanes is the maximum and hence the delivery quantity is the maximum. The control element 24 is rotated in opposite circumferential directions between the maximum capacity position and the minimum capacity position in response to the difference between the sum of the suction pressure Ps introduced into the low-pressure chamber $23_1$ and the urging force of the torsion coiled spring 38 and the control pressure Pc within the high-pressure chamber $23_2$. More specifically, when the suction pressure Ps is above the aforementioned predetermined value, the bellows 32*a* of the control valve device 32 is in its contracted state so that the ball valve element 32*c* closes the central hole 32*f*, i.e. the control valve device 32 is closed. This results in an increase in the control pressure Pc within the high-pressure chamber $23_2$, which in turn causes rotation of the control element 24 toward the maximum capacity position to increase the delivery quantity. As the discharge pressure increases, the force of the plunger 37 acting on the ball valve element 32*c* increases, so that the suction pressure Ps is controlled to a lower value. When the suction pressure Ps becomes equal to or lower than the predetermined value, the bellows 32*a* is expanded to cause the ball valve element 32*c* to open the central hole 33*f*, i.e. open the control valve device 33, whereby the control pressure Pc within the high-pressure chamber $23_2$ is allowed to leak into the suction chamber 11. This results in a decrease in the control pressure Pc, which in turn causes rotation of the control element 24 toward the minimum capacity position to decrease the delivery quantity. As the discharge pressure decreases, the force of the plunger 37 acting on the ball valve element 32*c* decreases, so that the suction pressure Ps is controlled to a higher value.

According to the bearing arrangement of the invention, during rotation, the control element 24 is not guided by the drive shaft 7 but guided by the inner peripheral surface 45*a* of the annular member 45, so that the respective inner peripheral surfaces 46*c*, 46*d* of the annular projection 46*a* and race 46 which is force-fitted in the hole 24*b* of the control element are always kept out of contact with the outer peripheral surface of the drive shaft 7. That is, the control element 24 is not guided by a rotary member, i.e. the drive shaft, but by a stationary member, i.e. the annular member 45 formed by casting in the through hole 41 of the rear side block 4. This makes it possible to prevent occurrence of galling between the control element 24 and the drive shaft 7 under any conditions including a condition of high rotational speed of the drive shaft 7 and a condition of high load on the compressor, as well as prevent wear of the surfaces of the control element 24 and the drive shaft 7 facing toward each other. Since the control element 24 is retained by the annular member 45 via the race 46, it is always kept in a position exactly at right angles to the axis of the drive shaft 7 as well as parallel with the opposed end face of the rotor 2, so that the clearance l can be maintained at the adjusted value, resulting in smooth rotation of the control element 24 and hence improved controllability of the compressor capacity. Further, the race 46 serves to absorb rotation of the control element 24 to prevent rotation of the race 44 due to the rotation of the control element 24 to thereby prevent wear of the through hole 41 of the rear side block, so that the clearance l is not changed even after long-term use. Therefore, the control element is always kept parallel with the rotor, whereby rattling thereof is reduced, which results in improved durability of the compressor as well as improved controllability of the compressor capacity.

Further, since the annular member 45 is formed by casting on the inner peripheral surfaces i.e. in the through hole 41 of the rear side block 4, and the radial bearing 9 formed of a ferrous material is force-fitted in the annular member 45 also formed of a ferrous material, it is possible to suppress a change in the clearance between the radial bearing 9 and the annular member 45 receiving same, caused by a rise in the temperature due to operation of the compressor, to thereby avoid occurrence of noise.

Besides, since the annular member 45 is cast in the through hole 41 of the rear side block 4, it is possible to machine the annular member 45 in coaxial relation to the through hole 41 of the rear side block 4. As a result, it is possible to improve the concentricity of the radial bearing 9 to the drive shaft 7 as well as suppress variation in the clearance between the radial bearing 9 and the annular member 45, to thereby further improve the reliability against occurrence of noise. Further, as distinct from a force-fitted type, the annular member 45 according to the present embodiment cannot rotate even under a heavy load condition of the compressor.

What is claimed is:

1. In a variable capacity vane compressor including a drive shaft, a rotor rigidly mounted on said drive shaft, a cylinder in which said rotor is rotatably received, said cylinder having a pair of side blocks, said side blocks each having formed therein a first hole through which said drive shaft extends, one of said side blocks having an end face facing said rotor and having a first annular recess formed therein, a capacity control element rotatably fitted in said first annular recess for controlling timing of start of compression of a refrigerant gas in said compressor, said capacity control element having an end face remote from said rotor, and a second hole through which said drive shaft extends, and a bearing arrangement arranged in said first hole of said one side block, said bearing arrangement having a radial bearing radially supporting said drive shaft, and a thrust bearing rotatably supporting said capacity control element, said thrust bearing having a first race disposed on a side thereof close to said rotor, and a second race disposed on a side remote from said rotor, the improvement wherein:

said bearing arrangement comprises an annular member fixed in said first hole of said one side block, said annular member having an inner peripheral surface in which said radial bearing and said thrust bearing are received, said annular member being formed of a material having a coefficient of thermal expansion substantially equal to that of a material forming said radial bearing, said first race of said thrust bearing being force-fitted in said second hole of said capacity control element and slidably fitted in said inner peripheral surface of said annular member, said first and second races having respective inner peripheral surfaces thereof spaced from an outer peripheral surface of said drive shaft.

2. A variable capacity vane compressor according to claim 1, wherein said annular member has a reduced-diameter hole receiving said radial bearing therein, and an increased-diameter hole receiving said thrust bearing therein, said first race of said thrust bearing on the rotor side being disposed in slidable contact with an inner peripheral surface of said increased-diameter hole of said annular member.

3. A variable capacity vane compressor according to claim 2, wherein said first race of the thrust bearing has an end face facing toward said rotor, and an annular projection formed integrally on said end face, said annular projection being force-fitted in said second hole of said capacity control element.

4. A variable capacity vane compressor according to claim 1, wherein said one side block is formed of aluminum, said annular member being formed of a material having a coefficient of thermal expansion smaller than that of aluminum.

5. A variable capacity vane compressor according to claim 4, wherein said annular member is formed of a ferrous metal.

6. A variable capacity vane compressor according to claim 5, wherein said annular member is formed of hardened steel.

7. A variable capacity vane compressor according to claim 4, wherein said annular member is formed by casting in said first hole of said one side block.

8. A variable capacity vane compressor according to claim 2, wherein said one side block is formed of aluminum or an alloy, said annular member being formed of a material having a coefficient of thermal expansion smaller than that of aluminum.

9. A variable capacity vane compressor according to claim 3, wherein said one side block is formed of aluminum, said annular member being formed of a material having a coefficient of thermal expansion smaller than that of aluminum.

10. A variable capacity vane compressor according to claim 1, wherein said one side block is formed of an aluminum alloy, said annular member being formed of a material having a coefficient of thermal expansion smaller than that of the aluminum alloy.

11. A variable capacity vane compressor according to claim 2, wherein said one side block is formed of an aluminum alloy, said annular member being formed of a material having a coefficient of thermal expansion smaller than that of the aluminum alloy.

12. A variable capacity vane compressor according to claim 3, wherein said one side block is formed of an aluminum alloy, said annular member being formed of a material having a coefficient of thermal expansion smaller than that of the aluminum alloy.

* * * * *

UNITED STATES PATENT AND TRADEMARK OFFICE

CERTIFICATE OF CORRECTION

PATENT NO. : 5,240,387

DATED : August 31, 1993

INVENTOR(S) : Nobuyuki NAKAJIMA

It is certified that error appears in the above-identified patent and that said Letters Patent is hereby corrected as shown below:

Column 10, line 37 (claim 8), delete "or an alloy"

Signed and Sealed this

Eighth Day of November, 1994

*Attest:*

*Attesting Officer*

Bruce Lehman

BRUCE LEHMAN

*Commissioner of Patents and Trademarks*